US006267054B1

(12) United States Patent
Lopes

(10) Patent No.: US 6,267,054 B1
(45) Date of Patent: Jul. 31, 2001

(54) RETAINING APPARATUS AND METHOD FOR HOLDING PRINTING PLATES ON A VACUUM DRUM

(75) Inventor: Fernando Lopes, Richmond (CA)

(73) Assignee: Creo Products Inc., Burnaby (CA)

( * ) Notice: Subject to any disclaimer, the term of this patent is extended or adjusted under 35 U.S.C. 154(b) by 0 days.

(21) Appl. No.: 09/266,831

(22) Filed: Mar. 12, 1999

(51) Int. Cl.[7] ..... B41F 27/00; B41F 1/28; B41F 21/00

(52) U.S. Cl. ..... 101/389.1; 101/383; 101/415.1

(58) Field of Search ..... 101/382.1, 383, 101/389.1, 415.1, 480; 492/22; 160/383

(56) References Cited

U.S. PATENT DOCUMENTS 2,999,453 * 9/1961 Roberts ..... 101/132
3,824,927 * 7/1974 Pugh et al. ..... 101/378
4,505,199 * 3/1985 Hasegawa et al. ..... 101/127.1
4,587,900 * 5/1986 Oshio ..... 101/382 MV
5,410,964 * 5/1995 Koelsch ..... 101/378
5,526,746 * 6/1996 Capdeboscq ..... 101/415.1
5,562,039 * 10/1996 Fox et al. ..... 101/486
5,865,433 * 2/1999 Morrissette ..... 271/276

FOREIGN PATENT DOCUMENTS

2028722 * 3/1980 (GB) .

* cited by examiner

*Primary Examiner*—Kimberly Asher
(74) *Attorney, Agent, or Firm*—Oyen Wiggs Green & Mutala

(57) ABSTRACT

A retainer for holding a printing plate to the cylindrical surface of a vacuum drum has a curved surface which conforms to and seals against the cylindrical surface of the drum. The retainer is held in place by pressure differential. An edge portion of a printing plate is received below a lip which extends along the retainer. The retainer is light in weight and therefore does not significantly unbalance the drum even if it is not always in the same position on the drum. The retainer is also inexpensive to manufacture and less likely than prior art clamps to cause damage if it fails.

24 Claims, 3 Drawing Sheets

RETAINING APPARATUS AND METHOD FOR HOLDING PRINTING PLATES ON A VACUUM DRUM

FIELD OF THE INVENTION

The invention relates to retaining printing plates on the cylindrical surface of a vacuum drum. The invention has particular application in computer-to-plate or computer-to-press systems.

BACKGROUND OF THE INVENTION

In the printing industry it is sometimes necessary to retain a plate on the cylindrical surface of a vacuum drum. For example, many computer-to-plate or computer-to-press systems image a lithographic printing plate which is held onto the outside surface of a rotating drum. In such systems the rotating drum has a cylindrical surface onto which a plate can be held. The cylindrical surface is typically perforated with an array of holes or other apertures. Air pressure in a plenum behind the cylindrical surface is reduced by a suitable vacuum pump. The resulting pressure differential between atmospheric pressure on one side of the plate and a reduced pressure on the side of the plate in contact with the cylindrical surface holds the plate against the cylindrical surface.

While such vacuum drums are well adapted to holding flexible films, they cannot always reliably hold metal printing plates. Metal printing plates have greater stiffness and thickness than films. Because of this, metal plates tend not to seal to the cylindrical surface of a vacuum drum as well as films. This reduces the pressure differential across the plates and reduces the forces which hold the plates to the drum. Leakage is especially significant in the areas near the edges of the plates.

Because metal plates are often heavier than comparable films the centrifugal forces which act on such plates when they are mounted on a rotating drum tend to be larger than those which act on films. For heavy plates mounted on a large drum which is rotating with a high angular velocity the centrifugal forces acting to pull the plates off of the rotating drum can approach the forces caused by the pressure differential across the plate which tends to hold the plate to the drum. The pressure differential across the plate is no more than one atmosphere and tends to be less in regions adjacent the edges of the plate where leakage is a problem.

Prior art approaches to the problem of holding plates to a rotating vacuum drum provide mechanical or magnetic clamps to hold both edges of a plate to a rotating drum. Providing such clamps is complicated because it should be possible to easily and quickly affix plates of different lengths to the same drum. A first clamp for holding a first edge of a plate may be at a fixed location on the surface of a drum. A second clamp for holding a second edge of the plate must be movable relative to the first clamp.

It is known to use magnetic clamps for the second clamp. A magnetic clamp consists essentially of an elongated member which contains one or more magnets. The magnets are attracted to the drum. The magnetic clamp may be simply placed over a second edge of a plate to hold the second edge of the plate to the drum. Such magnetic clamps have the advantage that they may be positioned as necessary to hold down the second edge of a plate. A disadvantage of such magnetic clamps is that the magnets which are required in the clamp are reasonably heavy. As a magnetic clamp is moved to accommodate plates of different lengths the balance of the drum will change. This can cause undesirable vibrations, especially when the drum is rotated at higher angular velocities. Furthermore, if a heavy magnetic clamp does fly off a drum during use it can cause significant damage to adjacent parts of the machinery.

It is known to hold steel plates to a drum by providing magnets inside the drum. This approach does not work with aluminum plates.

There is a need for a clamping system suitable for clamping the edges of printing plates of different sizes to a vacuum drum which avoids or reduces the above-noted disadvantages of currently available clamping systems. There is a particular need for such clamping systems that may be used on existing vacuum drums without the need to make structural modifications to the existing vacuum drums.

SUMMARY OF THE INVENTION

This invention provides a retainer for holding one end of a plate onto a cylindrical surface of a vacuum drum. The retainer has an elongated member which can be positioned on the cylindrical surface of a vacuum drum adjacent the edge of a printing plate. The member has a curved surface portion which conforms to the cylindrical surface of the drum. A lip extends along an edge of the member. The curved surface portion may be held by vacuum on the cylindrical surface with the edge of the printing plate received under the lip.

The retainer can be very light in weight so that it does not affect the balance of the drum, even if the retainer is not always at the same location on the drum. In preferred embodiments the retainer has a seal extending around a peripheral edge of the curved surface portion. The seal maximizes the force with which the retainer is held to the drum by preventing air from leaking under the edges of the retainer. A similar benefit may be obtained by facing the curved surface portion with an elastomeric material.

Another aspect of the invention provides a vacuum drum assembly wherein a retainer according to the invention holds a plate on a cylindrical surface of a vacuum drum.

A further aspect of the invention provides a method for retaining an edge portion of a plate to a vacuum drum. The method provides a retainer and a vacuum drum having a cylindrical surface with a radius of curvature. The retainer comprises an elongated member having a curved surface portion, the curved surface portion having a radius of curvature substantially equal to the radius of curvature of the cylindrical surface and, a lip extending along an edge of the member. The method includes wrapping a plate around the cylindrical surface of the vacuum drum; placing the retainer on the vacuum drum so that the lip projects over an edge portion of the plate and the curved surface portion adjoins the cylindrical surface; and, holding the retainer against the cylindrical surface by reducing a pressure within the vacuum drum so that the lip prevents the edge portion of the plate from lifting away from the cylindrical surface.

Further aspects of the invention are described below.

DESCRIPTION OF THE DRAWINGS

In drawings which illustrate specific embodiments of the invention.

DETAILED DESCRIPTION

Figure 1:
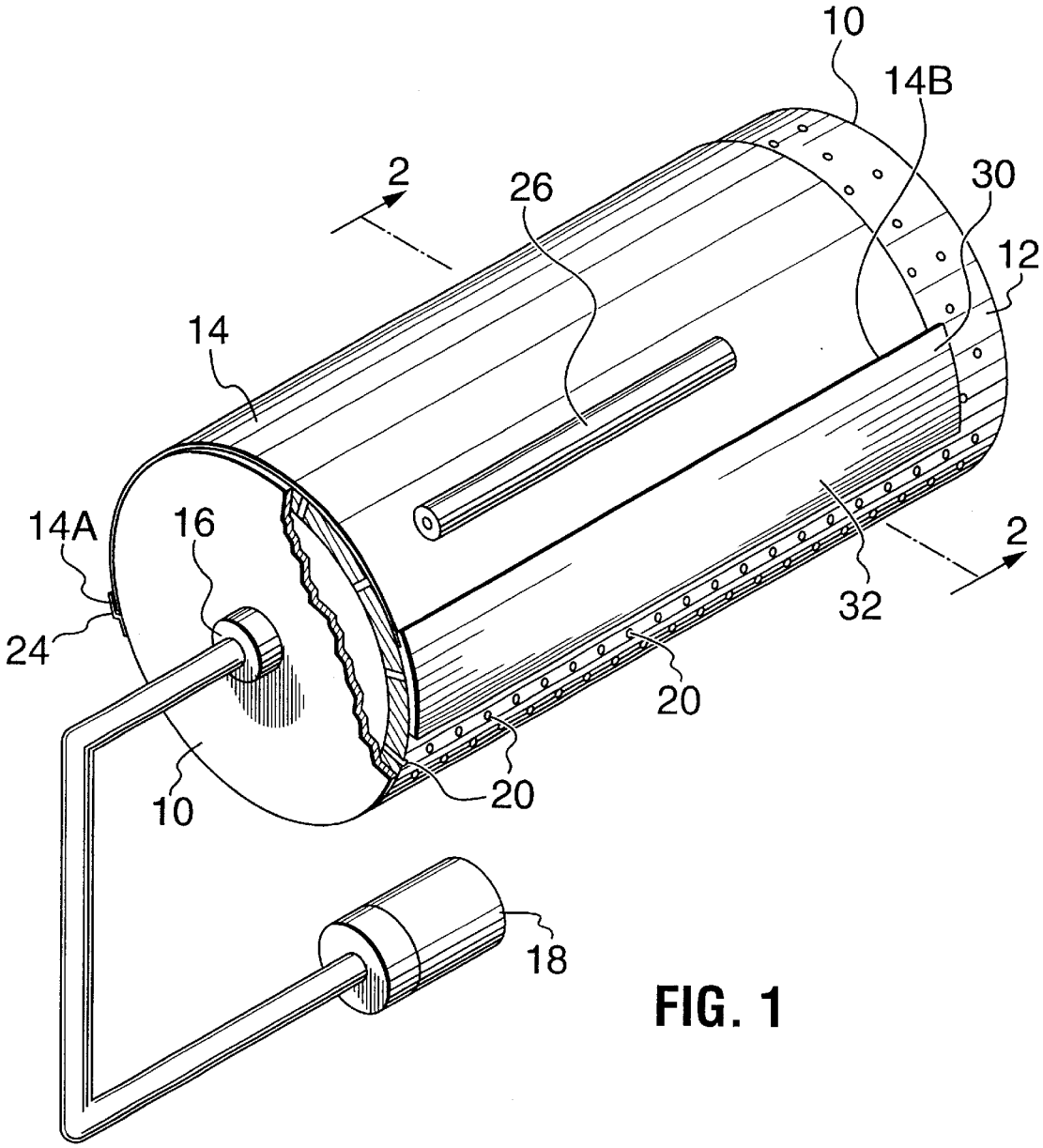
FIG. 1 is an isometric view of a vacuum drum in a printing machine equipped with retaining apparatus according to the invention.

FIG. 1 shows a vacuum drum 10 having an outer cylindrical surface 12 on which a printing plate 14 has been mounted. A port 16 connects an interior chamber within drum 10 to a suitable vacuum pump 18. Surface 12 is perforated by holes 20. Plate 14 is held against surface 12 by the pressure differential between atmospheric pressure, which acts on the outside surface of plate 14 and the reduced pressure acting on the inside surface of plate 14.

A first edge 14A of plate 14 is received in a conventional mechanical retainer 24. Mechanical retainer 24 may comprise any suitable known means for holding first edge 14A of plate 14 on drum 10. Mechanical retainer 24 may be termed a clamp means.

Figure 2:
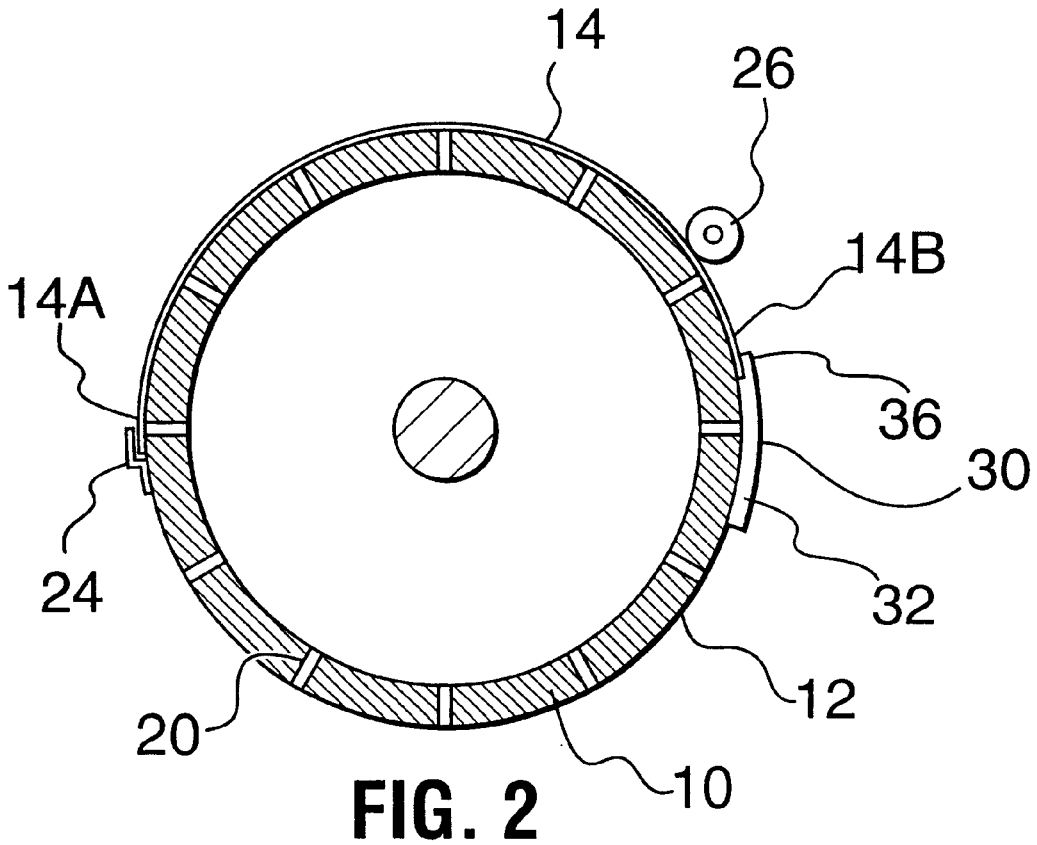
FIG. 2 is a section through the apparatus of FIG. 1 on the lines 2—2.
Figure 3:
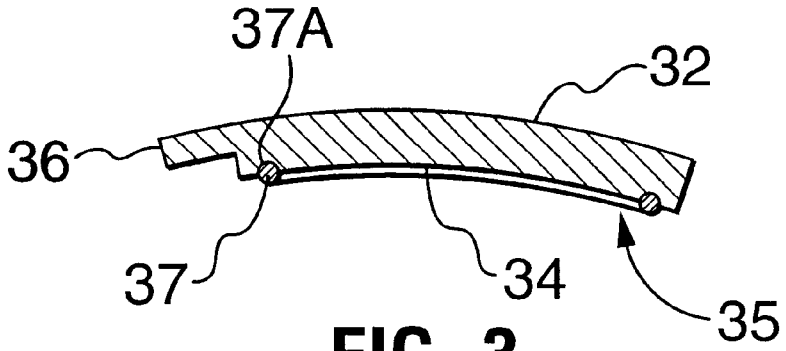
FIG. 3 is a section through the retainer of FIG. 1.

A second edge 14B of plate 14 is held onto surface 12 by a retaining apparatus 30 according to the invention. As shown in FIGS. 1 through 3, retaining apparatus 30 comprises a member 32 which may be made of any suitable material. Member 32 is preferably made from a low density material such as a suitable plastic. Member 32 has a surface 34 (FIG. 3) which is curved to conform with surface 12 of drum 10. When member 32 is placed on drum 10 with surface 34 on surface 12, member 32 is held onto surface 12 by the pressure differential across member 32. Surface 34 preferably has a seal 35 around its peripheral edge so that leakage of air from around the periphery of surface 34 into the region between surface 34 and surface 12 is minimized and the maximum pressure differential is maintained across member 32. In the embodiment of FIGS. 1–3, seal 35 comprises an elastomeric ring 37 received in a groove 37A in member 32. A similar effect may be obtained by facing surface 34 with an elastomeric material. An elastomeric material on portions of member 32 which contact surface 12 also helps to prevent member 32 from shifting circumferentially relative to drum 10 while retainer 30 is being used. Member 32 may be termed a retainer holding means.

Second edge 14B of plate 14 is received under a lip 36 which projects from member 32. Lip 36 keeps second edge 14B from lifting away from surface 12 as drum 10 spins. Retaining apparatus 30 may be termed a freely positionable means for holding a second end of the plate onto the cylindrical outer surface because it is not constrained to any discrete locations on surface 12. It is possible to adjust the position of retaining apparatus 30 continuously. Retainer 30 and mechanical retainer 24 may be collectively termed means for holding plates of various lengths onto the outer cylindrical surface of the vacuum drum.

In use, first edge 14A of plate 14 is inserted into mechanical retainer 24 and drum 10 is rotated slowly while vacuum pump 18 is operated and plate 14 is pressed against surface 12 by a retractable guide roller 26. This is continued until plate 14 is wrapped around surface 12 with second edge 14B adjacent to surface 12. Then retainer 30 is placed onto surface 12 with second edge 14B of plate 14 under lip 36 and surface 34 sealed against surface 12. Mechanical retainer 24 and retainer 30 then hold the edges of plate 14 against surface 12.

It can be appreciated that retainer 30 may be light in weight because it does not need to contain magnets or other heavy materials. Therefore, retainer 30 will not significantly affect the balance of drum 10. Furthermore, retainer 30 is less likely than a heavy magnetic clamp to damage adjacent structures if it does fly off of drum 10 when drum 10 is rotating.

As will be apparent to those skilled in the art in the light of the foregoing disclosure, many alterations and modifications are possible in the practice of this invention without departing from the spirit or scope thereof. For example, While lip 36 is illustrated in FIGS. 1 and 2 as extending all along one edge of member 32, lip 36 could comprise several sections which can project over an edge of a printing plate and which are separated by gaps. Lip 36 may be termed a plate holding means.

Figure 4A:
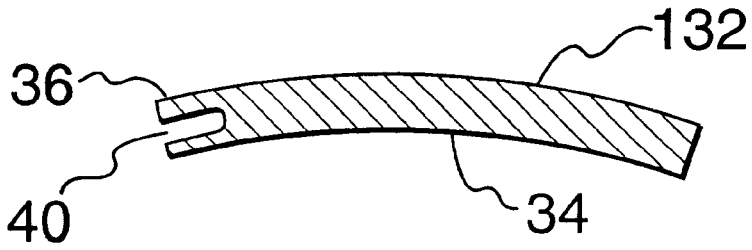
FIGS. 4A and 4B are sections through a retainers according to alternative but non-preferred embodiments of the invention.
Figure 4B:
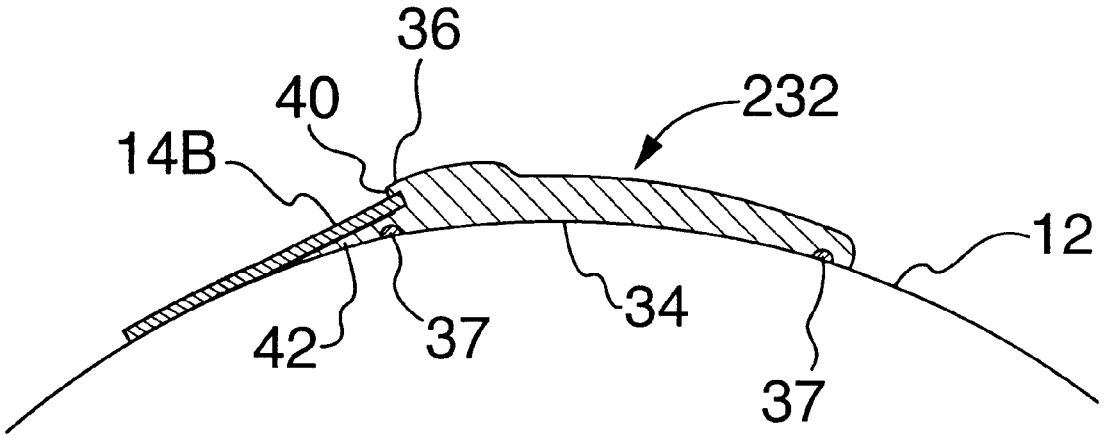

In the retaining member 132 of FIG. 4A, lip 36 is formed by an upper side of a groove 40 which extends longitudinally along one edge of member 132. The embodiment of FIG. 4A is not preferred because it is generally desirable for edge 14B to be held closely against surface 12. In the further alternative retaining member 232 of FIG. 4B, the area of surface 34 is maximized by providing member 32 with a wedge-shaped ridge 42 which extends under edge 14B of plate 14. Wedge-shaped ridge 42 forms a lower side of groove 40.

Those skilled in the art will be able to conceive of various other embodiments of the invention which retain the inventive features described herein. Accordingly, the scope of the invention is to be construed in accordance with the substance defined by the following claims.

What is claimed is:

1. A retainer for holding one end of a plate onto a cylindrical surface of a vacuum drum having a radius of curvature, the retainer comprising:

(a) an elongated member having a curved surface portion, the curved surface Portion having a radius of curvature substantially equal to a radius of curvature of a vacuum drum; and, (b) a lip extending along an edge of the member;

whereby the curved surface portion may be held by vacuum onto the cylindrical surface of a vacuum drum with an edge of a printing plate received under the lip and no portion of the retainer projecting inwardly through the cylindrical surface of the vacuum drum wherein the retainer comprises a seal extending around a peripheral edge of the curved surface portion.

2. The retainer of claim 1 wherein the lip comprises an upper edge of a groove extending along an edge of the member.

3. The retainer of claim 2 wherein the lip comprises an upper edge of a groove extending along an edge of the member.

4. A retainer for holding one end of a plate onto a cylindrical surface of a vacuum drum having a radius of curvature, the retainer comprising:

(a) an elongated member having a curved surface portion, the curved surface portion having a radius of curvature substantially equal to a radius of curvature of a vacuum drum; and, (b) a lip extending along an edge of the member;

whereby the curved surface portion may be held by vacuum onto the cylindrical surface of a vacuum drum with an edge of a printing plate received under the lip and no portion of the retainer projecting inwardly through the cylindrical surface of the vacuum drum wherein the curved surface portion is faced with an elastomeric material.

5. The retainer of claim 4 wherein the lip comprises an upper edge of a groove extending along an edge of the member.

6. The retainer of claim 5 wherein a lower edge of the groove comprises a wedge-shaped ridge extending along the member.

7. The retainer of claim 6 wherein the curved surface portion forms the wedge-shaped ridge.

8. The retainer of claim 7 wherein the retainer comprises a seal extending around a peripheral edge of the curved surface portion.

9. A retainer for holding one end of a plate onto a cylindrical surface of a vacuum drum having a radius of curvature, the retainer comprising:

(a) an elongated member having a curved surface portion, the curved surface portion having a radius of curvature substantially equal to a radius of curvature of a vacuum drum; and, (b) a lip extending along an edge of the member, the lip comprising an upper edge of a groove extending along the edge of the member;

whereby the curved surface portion may be held by vacuum on the cylindrical surface of a vacuum drum with an edge of a printing plate received under the lip wherein a lower edge of the groove comprises a wedge-shaped ridge extending along the member.

10. The retainer of claim 9 wherein the wedge-shaped ridge is formed by an edge of the curved surface portion.

11. The retainer of claim 10 wherein the retainer comprises a seal extending around a peripheral edge of the curved surface portion.

12. The retainer of claim 10 wherein the curved surface portion is faced with an elastomeric material.

13. A vacuum drum assembly comprising:

(a) a cylindrical vacuum drum having a cylindrical surface, the surface hating a radius of curvature, (b) a plate wrapped around the cylindrical surface of the vacuum drum;

(c) a retainer holding one end of the plate onto the cylindrical surface of the vacuum drum, the retainer lacking any portion projecting inwardly through the cylindrical surface of the vacuum drum and comprising:

(i) an elongated member having a curved surface portion, the curved surface portion having a radius of curvature substantially equal to the radius of curvature of the vacuum drum, the elongated member held to the cylindrical surface by a pressure differential across the elongated member; and, (ii) a lip extending along an edge of the member, the lip projecting over an edge portion of the plate.

14. The vacuum drum assembly of claim 13 wherein the retainer is not attached to a printing plate.

15. A method for retaining an edge portion of a plate to a vacuum drum, the method comprising:

a) providing a retainer and a vacuum drum having a cylindrical surface with a radius of curvature, the retainer comprising:

i) an elongated member having a curved surface portion, the curved surface portion having a radius of curvature substantially equal to the radius of curvature of the cylindrical surface and, ii) a lip extending along an edge of the member;

b) wrapping a plate, which is not attached to the retainer, around the cylindrical surface of the vacuum drum;

c) placing the retainer on the vacuum drum so that the lip projects over an edge portion of the plate, the curved surface portion adjoins the cylindrical surface and the retainer does not protect inwardly through the curved surface of the vacuum drum; and, d) holding the retainer against the cylindrical surface by reducing a pressure within the vacuum drum to create a pressure differential across the retainer so that the lip prevents the edge portion of the plate from lifting away from the cylindrical surface.

16. A vacuum drum assembly adapted to hold a printing plate, the vacuum drum assembly comprising:

(a) a cylindrical vacuum drum having a cylindrical surface with a radius of curvature;

(b) a retainer capable of holding one end of a printing plate onto the cylindrical surface of the vacuum drum, the retainer not attached to a printing plate and freely positionable around the circumference of the vacuum drum and comprising:

(i) an elongated member having a curved surface portion, the curved surface portion having a radius of curvature substantially equal to the radius of curvature of the vacuum drum's cylindrical surface, the elongated member held to the cylindrical surface by a pressure differential across the elongated member the elongated member lacking any portion projecting inwardly through the cylindrical surface of the vacuum drum; and, (ii) a lip extending along an edge of the member for holding an edge portion of a printing plate to the vacuum drum.

17. A vacuum drum assembly adapted to hold a printing plate, the vacuum drum assembly comprising:

(a) a cylindrical vacuum drum having a cylindrical surface with a radius of curvature;

(b) a retainer capable of holding one end of a printing plate onto the cylindrical surface of the vacuum drum, the retainer freely positionable around the circumference of the vacuum drum and comprising:

(i) an elongated member having a surface adapted to seal against the curved surface of the vacuum drum, the elongated member held to the cylindrical surface by a pressure differential across the elongated member, the elongated member lacking any portion projecting inwardly through the cylindrical surface of the vacuum drum; and, (ii) a lip extending along an edge of the member, the lip spaced apart from the vacuum drum whereby the lip can receive and hold an edge portion of a printing plate to the vacuum drum.

18. A vacuum drum assembly including means for holding plates of various lengths onto an outer cylindrical surface of a vacuum drum, the vacuum drum assembly comprising:

a) a vacuum drum having a cylindrical outer surface; the means for holding plates of various lengths onto the outer cylindrical surface of the vacuum drum comprising:

b) clamp means on the vacuum drum for holding a first end of a plate onto the cylindrical outer surface; and, c) freely positionable means for holding a second end of the plate onto the cylindrical outer surface, the freely positionable means having a continuously adjustable position on the vacuum drum for accommodating plates of various lengths, the freely positionable means held to the cylindrical outer surface substantially entirely by vacuum.

19. The assembly of claim 18 wherein the freely positionable means comprises an elongated member having a surface adapted to seal against the curved surface of the vacuum drum, the elongated member held to the cylindrical surface by a pressure differential across the elongated member the elongated member lacking any portion projecting inwardly through the cylindrical surface of the vacuum drum.

20. A retainer for holding a plate to a cylindrical surface of a vacuum drum, the retainer comprising:

a) a retainer holding means for holding the retainer to the outer surface of a vacuum drum substantially entirely by a pressure differential across the retainer holding means; and, b) a plate holding means attached to the retainer holding means, the plate holding means comprising a member positionable outwardly from an edge of a plate while the retainer holding means is holding the retainer to the outer surface of the vacuum drum.

21. The retainer of claim 20 wherein the retainer holding means has a peripheral edge and comprises a seal extending around the peripheral edge.

22. A vacuum drum assembly adapted to hold printing plates of various lengths onto a cylindrical surface, the vacuum drum assembly comprising:

(a) a vacuum drum having a cylindrical surface, the cylindrical surface having a radius of curvature;

(b) a retainer capable of holding one end of a printing plate onto the cylindrical surface of the vacuum drum, the retainer not attached to a printing plate and having an angular position which is continuously adjustable on the cylindrical surface to accommodate plates of different lengths, the retainer comprising:

(i) an elongated member having a curved surface portion, the curved surface portion having a radius of curvature substantially equal to the radius of curvature of the vacuum drum's cylindrical surface, the elongated member held to the cylindrical surface by a pressure differential across the elongated member; and, (ii) a lip on the elongated member, the lip located to prevent the one end of a plate from lifting away from the cylindrical surface of the vacuum drum.

23. A vacuum drum assembly comprising:

(a) a vacuum drum having a cylindrical surface, the surface having a radius of curvature;

(b) a plate wrapped around the cylindrical surface of the vacuum drum, the plate having first and second ends, an angular position of the second end of the plate on the cylindrical surface determined by a length of the plate;

(c) a retainer holding the second end of the plate onto the cylindrical surface of the vacuum drum, the retainer comprising:

(i) an elongated member having a curved surface portion, the curved surface portion having a radius of curvature substantially equal to the radius of curvature of the vacuum drum, the elongated member held to the cylindrical surface by a pressure differential across the elongated member and having an angular position on the cylindrical surface that is continuously variable to accommodate plates having different lengths; and, (ii) a lip on the elongated member, the lip projecting over the second end of the plate to prevent the second end of the plate from lifting away from the cylindrical surface.

24. A method for retaining plates having various lengths on a vacuum drum, the method comprising:

a) providing a retainer and a vacuum drum having a cylindrical surface the retainer comprising:

i) an elongated member having a curved surface portion, and, ii) a laterally extending lip on the elongated member;

b) wrapping a plate having first and second ends around the cylindrical surface of the vacuum drum with the first end of the plate at a first angular position on the cylindrical surface and the second end of the plate at a second angular position on the cylindrical surface determined by a length of the plate;

c) placing the retainer on the vacuum drum so that the lip projects over the second end of the plate and the curved surface portion adjoins the cylindrical surface; and, d) holding the plate and retainer against the cylindrical surface by reducing a pressure within the vacuum drum to create a pressure differential across the elongated member so that the lip prevents the second end of the plate from lifting away from the cylindrical surface.

* * * * *